US010520965B2

(12) United States Patent
Hsieh et al.

(10) Patent No.: US 10,520,965 B2
(45) Date of Patent: Dec. 31, 2019

(54) SERVER ROOM POWER MANAGEMENT APPARATUS AND METHOD THEREOF

(71) Applicant: CYBER POWER SYSTEMS, INC., Taipei (TW)

(72) Inventors: Hung-Ming Hsieh, Taipei (TW); Hung-Chun Chien, Taipei (TW); Yung-Hao Peng, Taipei (TW)

(73) Assignee: CYBER POWER SYSTEMS, INC., Taipei (TW)

( * ) Notice: Subject to any disclaimer, the term of this patent is extended or adjusted under 35 U.S.C. 154(b) by 385 days.

(21) Appl. No.: 14/990,330

(22) Filed: Jan. 7, 2016

(65) Prior Publication Data

US 2016/0224046 A1 Aug. 4, 2016

(30) Foreign Application Priority Data

Feb. 4, 2015 (TW) ..... 104103691 A

(51) Int. Cl.
*G05F 1/66* (2006.01)

(52) U.S. Cl.
CPC ..... *G05F 1/66* (2013.01)

(58) Field of Classification Search
CPC ..... G05F 1/66
USPC ..... 700/286
See application file for complete search history.

(56) References Cited

U.S. PATENT DOCUMENTS 8,305,737 B2 11/2012 Ewing et al.
9,142,971 B2 * 9/2015 Ewing ..... H04L 12/10
2011/0062780 A1 * 3/2011 Verges ..... H02J 13/001 307/38
2011/0187193 A1 * 8/2011 Pan ..... H02J 3/14 307/39
2013/0190899 A1 * 7/2013 Slessman ..... G05B 13/02 700/28
2013/0253861 A1 * 9/2013 Nicholson ..... G06F 11/3062 702/62
2013/0261821 A1 * 10/2013 Lu ..... H04L 12/2807 700/289
2016/0140468 A1 * 5/2016 Langborg-Hansen ..... G06Q 50/06 705/7.23

FOREIGN PATENT DOCUMENTS

| | | | |
|---|---|---|---|
| CN | 102195785 | A | 9/2011 |
| CN | 102819310 | A | 12/2012 |
| TW | 201312333 | A | 3/2013 |
| TW | 1427889 | B | 2/2014 |
| TW | 1429164 | B | 3/2014 |

* cited by examiner

*Primary Examiner* — Robert A Cassity
(74) *Attorney, Agent, or Firm* — Bacon & Thomas, PLLC

(57) ABSTRACT

A server room power management apparatus and method, the power management apparatus comprising a first PDE (power distribution equipment), at least one second PDE and at least one DM (digital meter); wherein a first network interface unit of the first PDE, a second network interface unit of the second PDE and the DM can be connected to become a network; the power management method uses a first processor of the first PDE to collect power consumptions of the second PDE and the DM; wherein, the first processor can work out power usage effectiveness; thus, the apparatus and method do not need an independent server device, that will reach power saving and reduce apparatus costs.

22 Claims, 16 Drawing Sheets

SERVER ROOM POWER MANAGEMENT APPARATUS AND METHOD THEREOF

BACKGROUND OF THE INVENTION

1. Field of the Invention

The invention relates to a power management apparatus and method, and more particularly to a power management apparatus and method use for a server room, the power management apparatus and method can collect power consumption of a plurality of PDEs (power distribution equipment) and at least one DM (digital meter), the invention does not need an independent server device, and it can count PUE (power usage effectiveness) of each period by one of the PDEs, especially to apply to a small server room.

2. Description of Related Art

U.S. Pat. No. 8,305,737 entitled "Power distribution apparatus with input and output power sensing and method of use" disclosed a framework in its FIG. 26, it does need a particular SPM (sentry power manager), an independent SQL server database and an independent Web server to collect power consumption information of each PDU and count PUE. Thus, prior-art can not collect the power consumption information by one of PDUs, and it can not count the PUE by one of the PDUs.

Moreover, SPM, SQL server database and Web server of prior-art need extra power supply, and therefore increase the power consumption of prior-art, there is not helpfulness for the PUE. The prior-art did not count electric power of SPM, SQL server database, Web server and network apparatus to the PUE, it did not consider the power consumption conditions of SPM, SQL server database, Web server and network apparatus. Furthermore, SPM, SQL server database and Web server of prior-art need higher apparatus costs, that will be not suitable for a small server room.

SUMMARY OF THE INVENTION

It is therefore an object of the invention to provide a server room power management apparatus comprising a first PDE (power distribution equipment), at least one second PDE and at least one DM (digital meter); the first PDE, the second PDE and the DM can be connected to become a network (e.g., a first network interface unit of the first PDE, a second network interface unit of the second PDE and the DM use a plurality of network cables to connect to a network hub); wherein a first processor of the first PDE can collect power consumptions of the second PDE and the DM, the first processor can work out PUE (power usage effectiveness).

It is therefore another object of the invention to provide a server room power management method comprising a step 1, a first PDE requesting a second PDE and a DM (digital meter) to report self power consumption at regular time; a step 2, the first PDE, the second PDE and the DM measuring self power consumption of each period; a step 3, the first PDE collecting measured power consumption of step 2 via a network, and the measured power consumption of step 2 will be temporarily saved in a memory of the first PDE; a step 4, the first PDE working out a PUE (power usage effectiveness) of each period, and the PUE will be temporarily saved in the memory of the first PDE; looping steps 2 to 4, therefore can continuously measure the power consumption of each period, and continuously work out the PUE of each period; wherein the network is formed by a network hub used a plurality of network cables to connect to the first PDE, the second PDE and the DM.

First advantages of the invention is, the invention does not need an independent server device, therefore can reach purpose of power saving. However, the above prior-art has an independent server device, the independent server device needs extra power supply, that will be unhelpful for the PUE.

Second advantages of the invention is, the invention can work out the PUE to conform to actual conditions of the power consumption. However, the above prior-art has an independent server device, the power consumption of the independent server device and network apparatus is not counted in the PUE.

Third advantages of the invention is, the invention does not need an independent server device, therefore can reduce apparatus costs, especially to apply to a small server room. However, the above prior-art has an independent server device, the independent server device needs higher apparatus costs.

The above and other objects, features and advantages of the invention will become apparent from the following detailed description taken with the accompanying drawings.

DETAILED DESCRIPTION OF THE INVENTION

Figure 1:
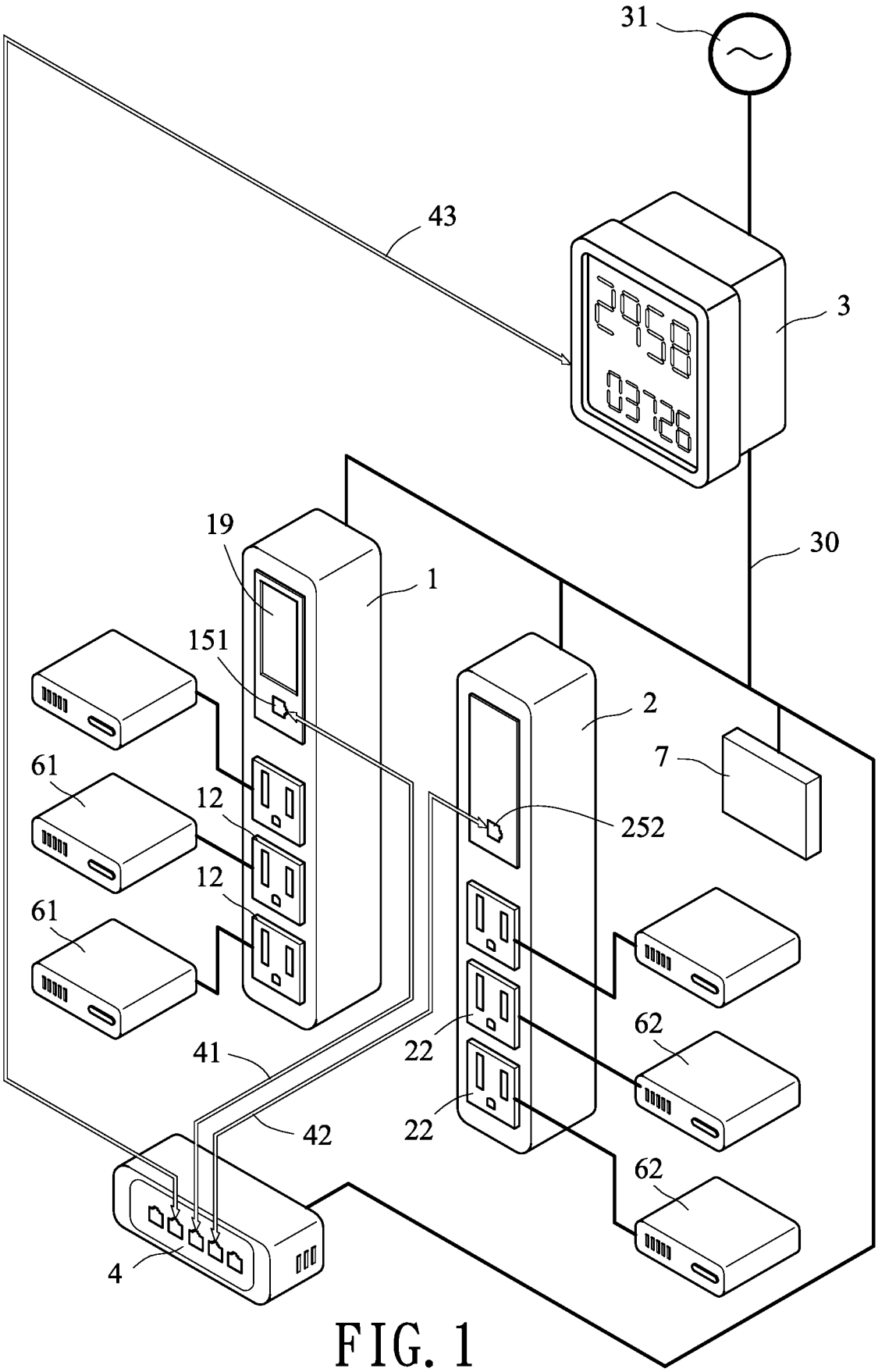
FIG. 1 is a perspective view showing a power management apparatus of a first embodiment of the invention.
Figure 1A:
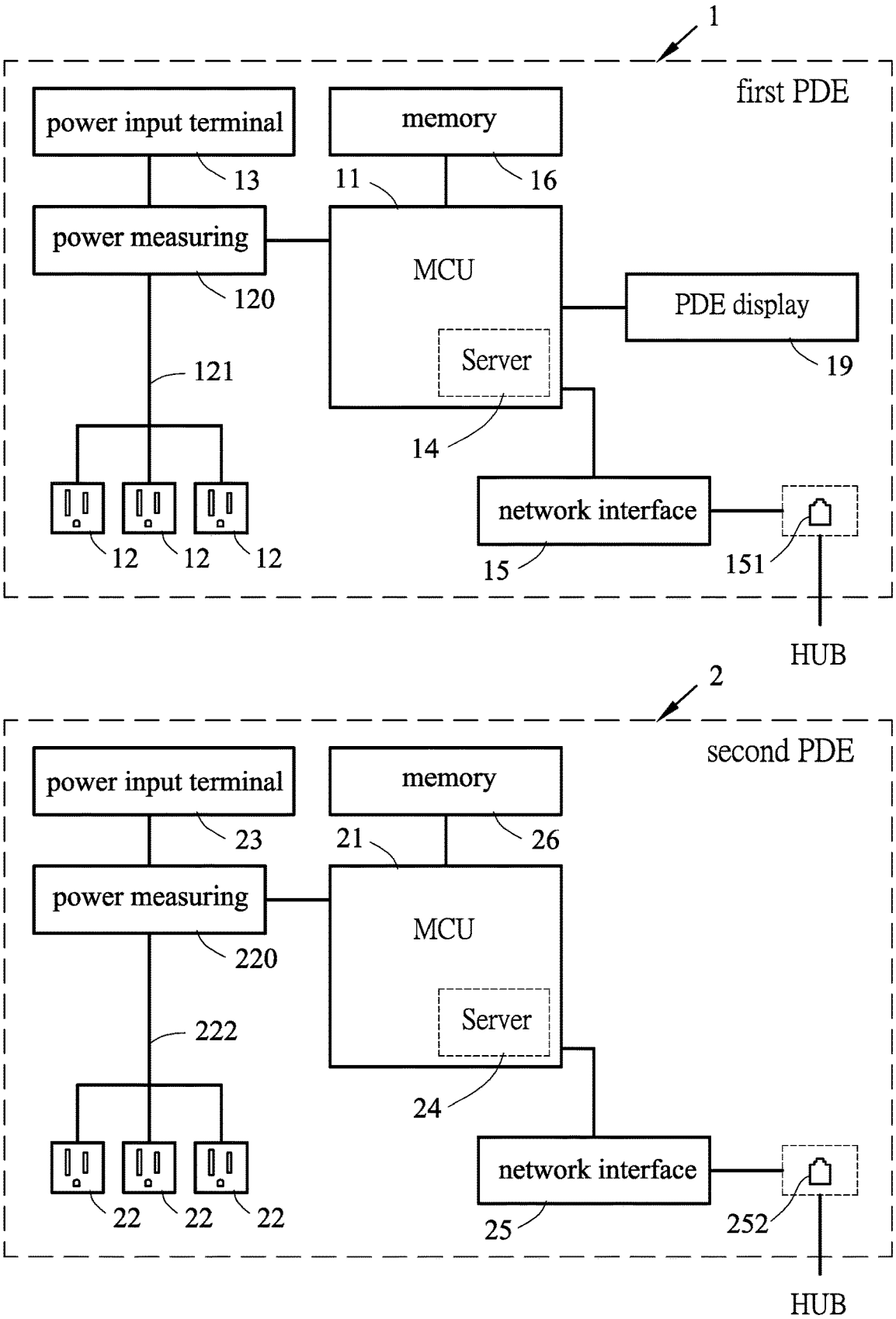
FIG. 1A is a functional block diagram illustrating the power management apparatus of the first embodiment of the invention.

Referring to FIGS. 1 to 1A, a server room power management apparatus in accordance with a first embodiment of the invention comprises a first PDE (power distribution equipment) 1, at least one second PDE 2, at least one DM (digital meter) 3 and a network hub 4; the first PDE 1 has a first processor unit 11 and a plurality of first outlets 12, the first processor unit 11 can use a first power measuring unit 120 to measure a power consumption of the first outlets 12, the first processor unit 11 can be a MCU (microcontroller unit) having a function of a first server 14, for example, but not limited to ARM-base MCU, and the first processor unit 11 connects to a first network interface unit 15; the second PDE 2 has a second processor unit 21 and a plurality of second outlets 22, the second processor unit 21 can use a second power measuring unit 220 to measure a power consumption of the second outlets 22, the second processor unit 21 can be a MCU (microcontroller unit) having a function of a second server 24, for example, but not limited to ARM-base MCU, and the second processor unit 21 connects to a second network interface unit 25; the DM 3 is connected to mains power supply, therefore can measure a power consumptions of a power line 30, a first power input terminal 13 of the first PDE 1 and a second power input terminal 23 of the second PDE 2 connect to the power line 30; the network hub 4 uses a plurality of network cables 41-43 to connect to the first network interface unit 15, the second network interface unit 25 and the DM 3; wherein the first processor unit 11 can collect an external power consumption information, and the first processor unit 11 can work out a PUE (power usage effectiveness) according to the power consumption which is measured by the first power measuring unit 120 and the external power consumption information, the external power consumption information have at least one power consumption of the second PDE 2 and at least one power consumption of the DM 3. Moreover, the first PDE 1 can be provided with a PDE display 19, therefore the PUE counted by the first processor unit 11 can be showed on the first PDE 1.

Examples of the power usage manner of the first PDE 1, the second PDE 2 and the DM 3 will be illustrated below, the DM 3 connect to the mains power supply to measure the power consumption of the power line 30, the power line 30 is connected to the first power input terminal 13 of the first PDE 1, a second power input terminal 23 of the second PDE 2 and other devices 7; wherein the first outlets 12 and the second outlets 22 can supply power to a plurality of information devices 61-62, other devices 7 can be air condition device, lighting device, safety device and other powered device. Moreover, the PUE of each period can be defined as the power consumption measured by the DM 3 (in the period) divided by the power consumption of the information devices 61-62 (in the period). Furthermore, the above prior-art has an independent server device, the independent server device needs extra power supply, but the invention does not need an independent server device, therefore can reach purpose of power saving.

Examples of the power measuring manner of the first PDE 1, the second PDE 2 and the DM 3 will be illustrated below, the first power measuring unit 120 can be a current sensor, a voltage sensor or a power meter, which is located between the first outlets 12 and the first power input terminal 13, therefore can measure a electric current or voltage of a circuit 121; wherein the circuit 121 is used to connect the first outlets 12 with the first power input terminal 13, thereby the first processor unit 11 can measure power consumption of the first outlets 12 by the first power measuring unit 120. The second power measuring unit 220 can be a current sensor, a voltage sensor or a power meter, which is located between the second outlets 22 and the second power input terminal 23, therefore can measure a electric current or voltage of a circuit 222; wherein the circuit 222 is used to connect the second outlets 22 with the second power input terminal 23, thereby the second processor unit 21 can measure power consumption of the second outlets 22 by the second power measuring unit 220. The DM 3 can measure the power consumption of the power line 30 including the power consumption of the first PDE 1, the second PDE 2, the network hub 4 and other devices 7. Thus, a power consumption which is used to count power usage effectiveness will be counted into the PUE. Because of the above prior-art has an independent server device, the power consumption of the independent server device is not counted into power usage effectiveness. Thus, the PUE of the invention will be more conformed to actual conditions of the power consumption.

Examples of the signal communication manner of the first PDE 1, the second PDE 2 and the DM 3 will be illustrated below, the function of the first server 14 of the first processor unit 11 can select from Web server function, SNMP server function, Modbus server function or Telnet server function, the first network interface unit 15 has a first network port 151, the first network interface unit 15 can be a built-in Ethernet interface or an optical fiber network interface, the first network port 151 can be a RJ45 network socket or an optical fiber network socket; the function of the second server 24 of the second processor unit 21 can select from Web server function, SNMP server function, Modbus server function or Telnet server function, the second network interface unit 25 has a second network port 252, the second network interface unit 25 can be a built-in Ethernet interface or an optical fiber network interface, the second network port 252 can be a RJ45 network socket or an optical fiber network socket; wherein the first network port 151 can connect to the network hub 4 by the network cable 41, the second network port 252 can connect to the network hub 4 by the network cable 42, and the DM 3 can connect to the network hub 4 by the network cable 43, thereby the first PDE 1 and the second PDE 2 can transfer the signal each other, the first PDE 1 and the DM 3 can transfer the signal each other. Moreover, the above prior-art has an independent server device, the independent server device needs higher apparatus costs, but the invention does not need an independent server device, therefore can substantially reduce apparatus costs, especially to apply to a small server room.

Figure 2:
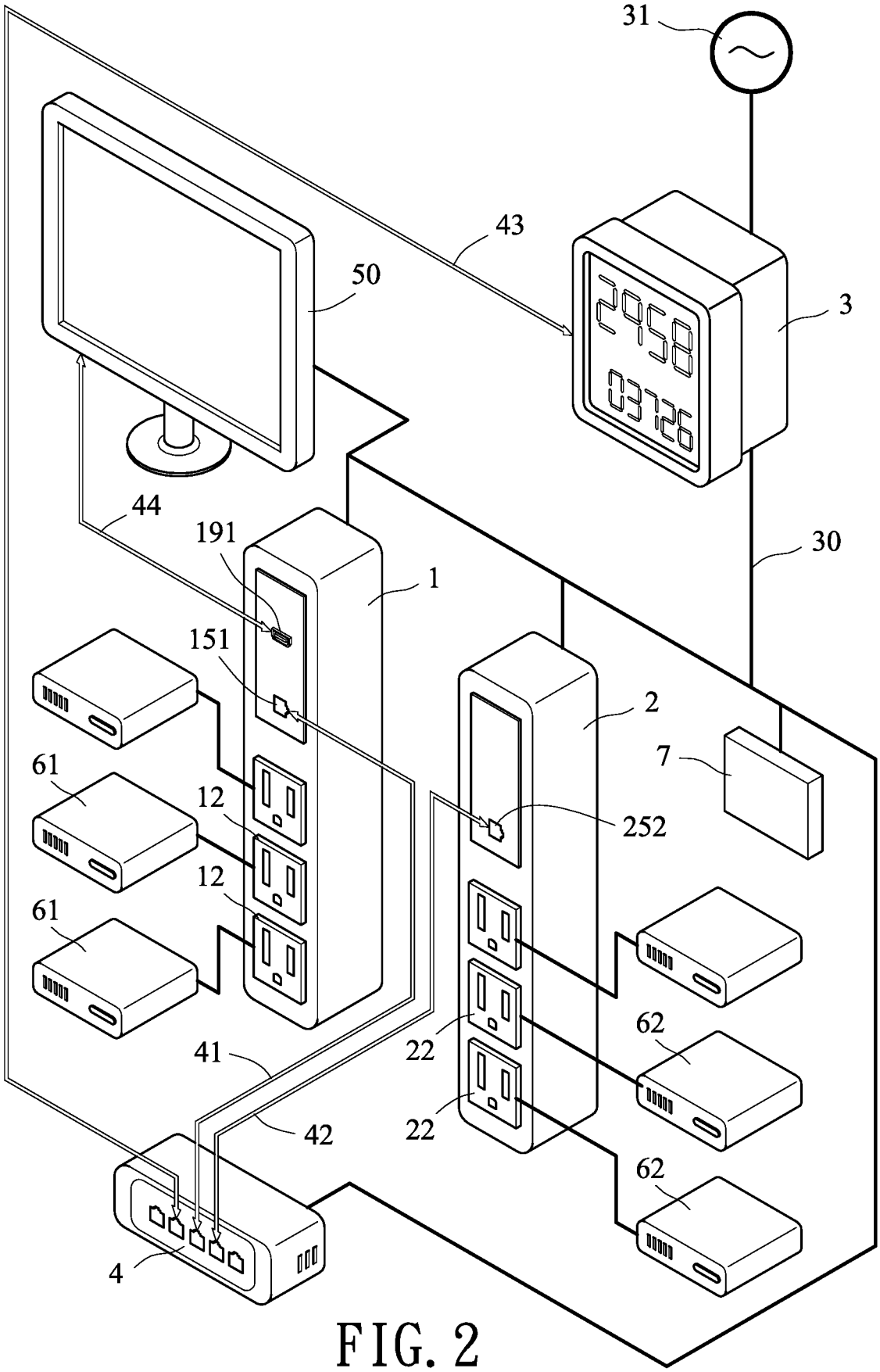
FIG. 2 is a perspective view showing a power management apparatus of a second embodiment of the invention.
Figure 2A:
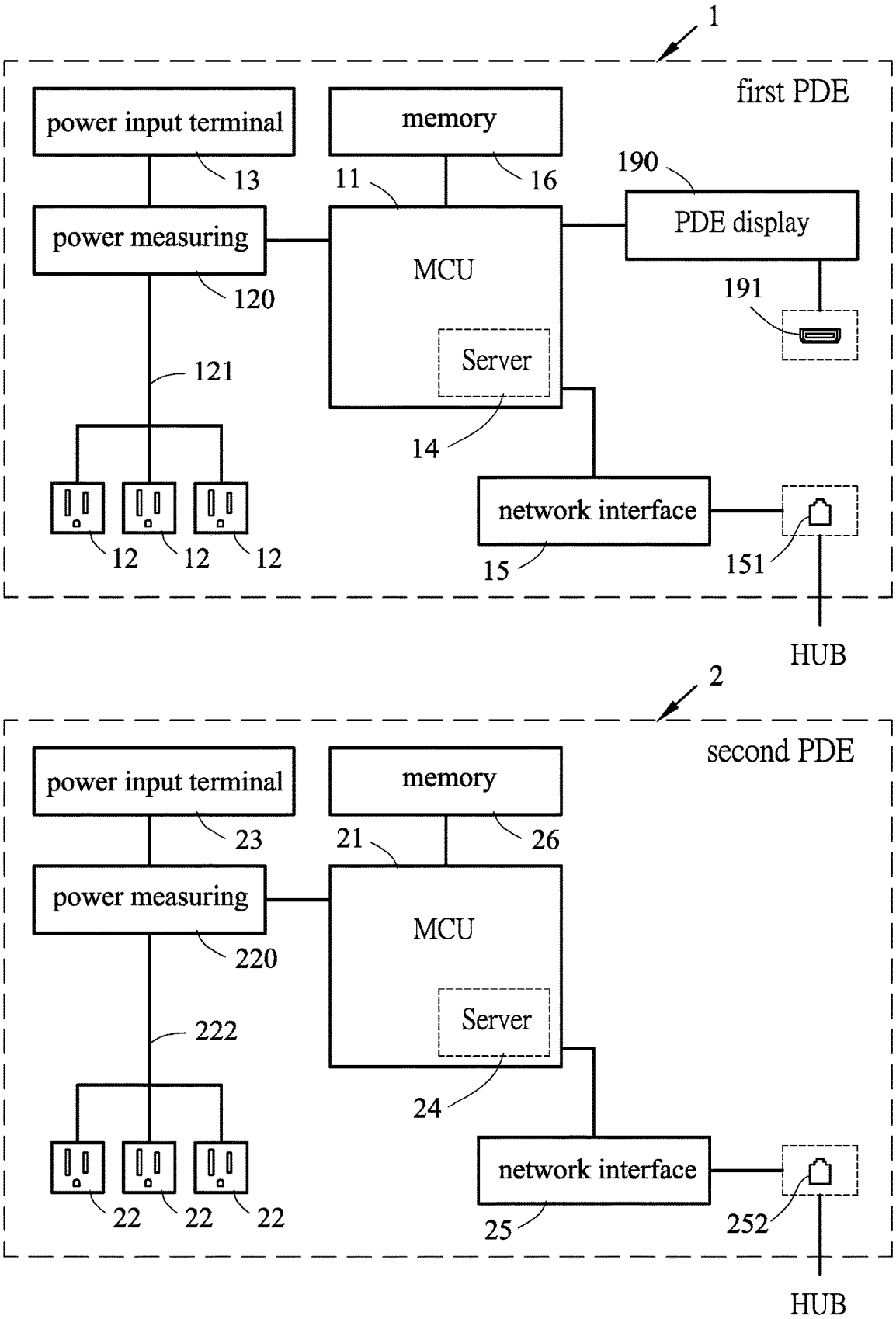
FIG. 2A is a functional block diagram illustrating the power management apparatus of the second embodiment of the invention.

Referring to FIGS. 2 to 2A, a second embodiment apparatus is almost same as the first embodiment apparatus, the difference between them is, the first PDE 1 has a display interface 190, the display interface 190 connects to the first processor unit 11, and the display interface 190 connects a display output port 191; wherein the display output port 191 can connect to an independent display 50 by a signal cable 44, the independent display 50 is connected to power line 30, the first processor unit 11 will output the PUE to the independent display 50 by the display interface 190 and the display output port 191. The display interface 190 can select from a VGA (Video Graphics Array) interface, a HDMI (High Definition Multimedia) interface or a Mini Display interface, the display output port 191 can select from a D-sub socket, a HDMI socket or a Mini Display socket.

Figure 3:
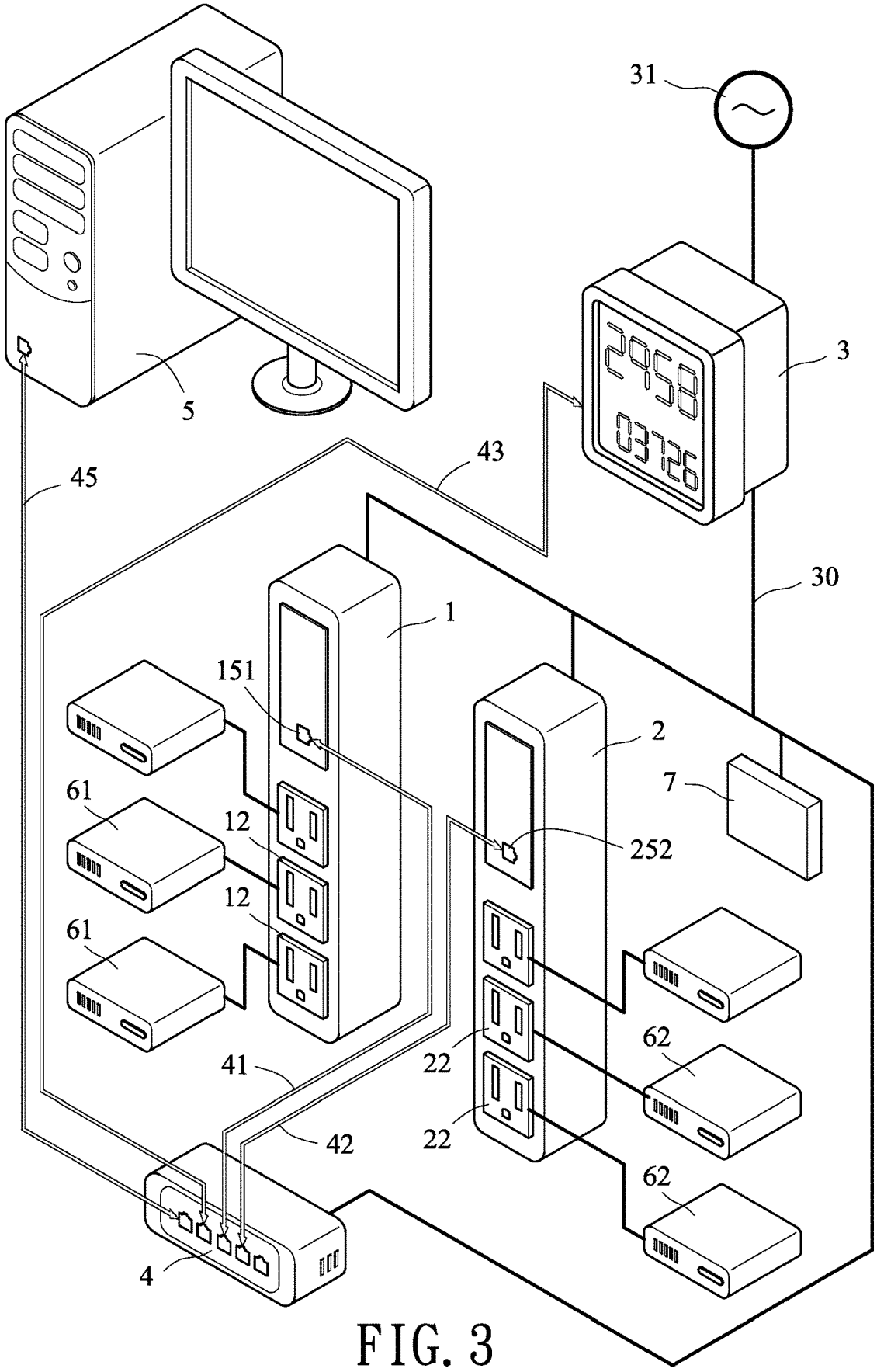
FIG. 3 is a perspective view showing a power management apparatus of a third embodiment of the invention.
Figure 3A:
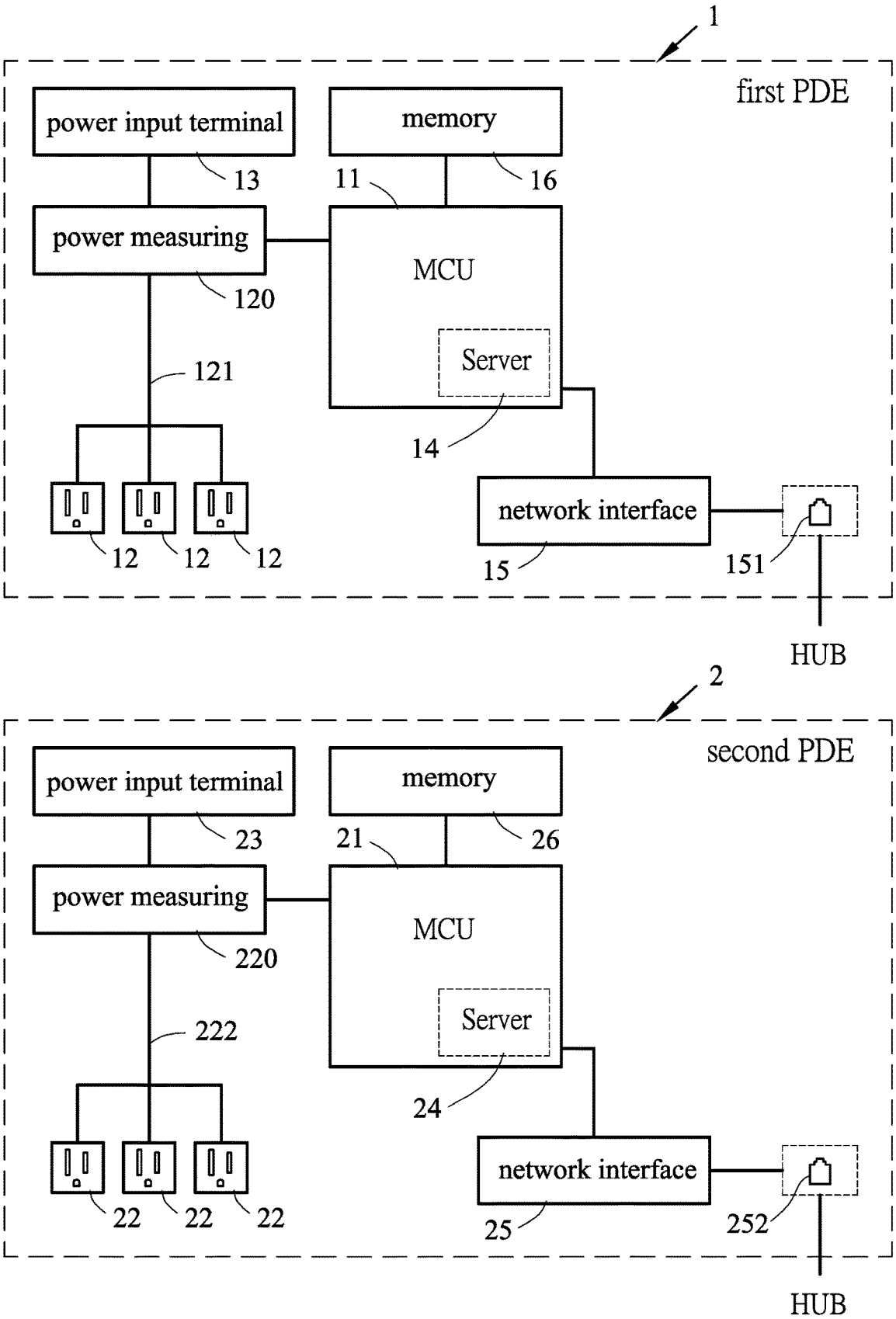
FIG. 3A is a functional block diagram illustrating the power management apparatus of the third embodiment of the invention.

Referring to FIGS. 3 to 3A, a third embodiment apparatus is almost same as the first embodiment apparatus, the difference between them is, the power consumption of the first outlets 12 measured by the first processor unit 11 can temporarily saved in a first memory 16, the power consumption of the second outlets 22 measured by the second processor unit 21 can temporarily saved in a second memory 26; wherein the PUE counted by the first processor unit 11 can temporarily saved in a first memory 16, and the network hub 4 can connect to a manager 5 by a network cable 45, therefore can access, backup and display the PUE which is counted by the first processor unit 11, the manager 5 can select from a personal computer, a notebook computer, a tablet computer or an all-in-one computer.

Figure 4:
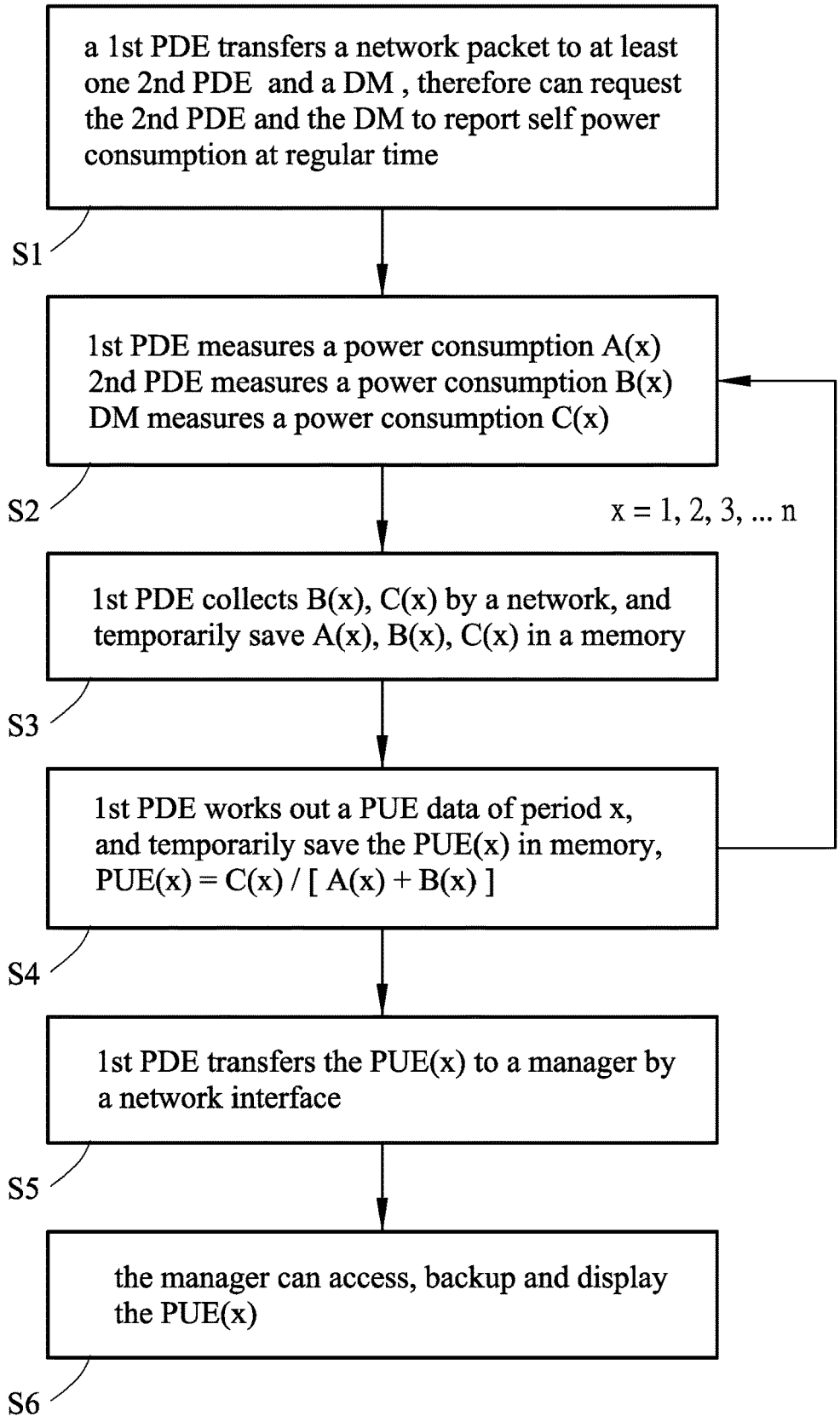
FIG. 4 is a flowchart illustrating the power management method of a fourth embodiment of the invention.

Referring to FIG. 4 and FIGS. 3 to 3A, a server room power management method in accordance with a fourth embodiment of the invention comprises a step S1, a first PDE 1 transfers a network packet to at least one second PDE 2 and a DM 3, therefore can request the second PDE 2 and the DM 3 to report self power consumption at regular time; a step S2, the first PDE 1 measures a power consumption A(x) of a period x, the second PDE 2 measures a power consumption B(x) of the period x, and the DM 3 measures a power consumption C(x) of the period x; a step S3, the first PDE 1 collects the power consumptions B(x), C(x) by a network, and the first PDE 1 will temporarily save the power consumptions A(x), B(x), C(x) in a first memory 16 of the first PDE 1; a step S4, the first PDE 1 works out a PUE (power usage effectiveness) data of the period x, the PUE data is determined by a formula as below: PUE(x)=C(x)/[A(x)+B(x)], the PUE(x) is the power usage effectiveness of the period x, and the first PDE 1 will temporarily save the PUE(x) in the first memory 16; looping steps S2 to S4, therefore can continuously measure the power consumptions A(x), B(x), C(x) of each period x, and continuously work out the PUE(x) of each period x, the value x is in a range from 1 to N; wherein the network is formed by a network hub 4 used a plurality of network cables 41-43 to connect to the first PDE 1, the second PDE 2 and the DM 3.

Examples of the PUE access steps, the PUE backup steps and the PUE display steps of the fourth embodiment will be illustrated below, the fourth embodiment further comprises a step S5, the first processor unit 11 of the first PDE 1 transfers the power usage effectiveness PUE(x) of each period x to a manager 5 by a first network interface unit 15; and a step S6, the manager 5 can access, backup and display the above PUE(x).

Figure 5:
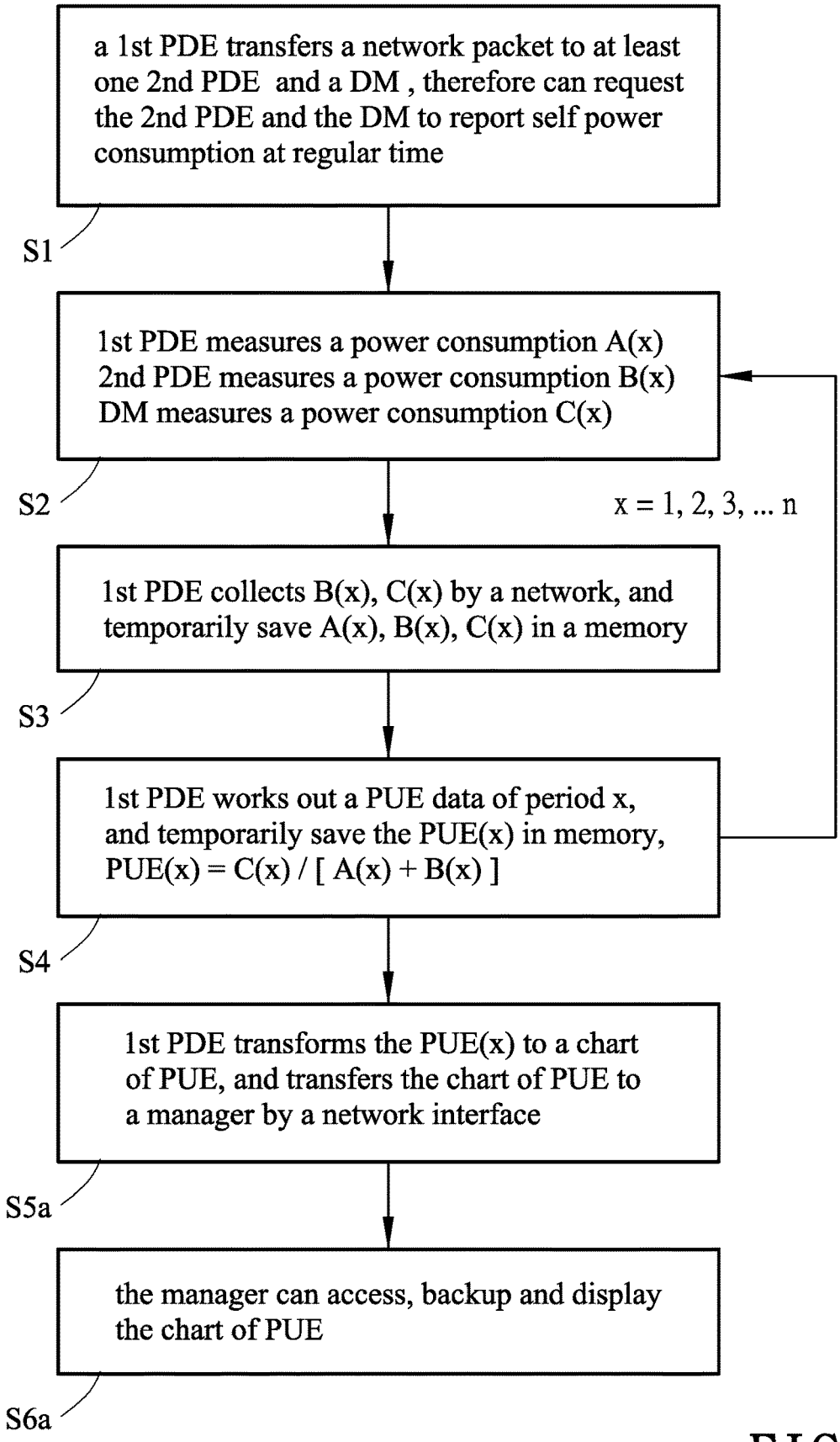
FIG. 5 is a flowchart illustrating the power management method of a fifth embodiment of the invention.

Referring to FIG. 5 and FIGS. 3 to 3A, a fifth embodiment method is almost same as the fourth embodiment method, the difference between them is, the fifth embodiment method has a step S5*a*, the first processor unit 11 of the first PDE 1 transforms the above PUE(x) to a chart of PUE, and the first processor unit 11 transfers the chart of PUE to a manager 5 by the first network interface unit 15; and a step S6*a*, the manager 5 can access, backup and display the chart of PUE.

Figure 6:
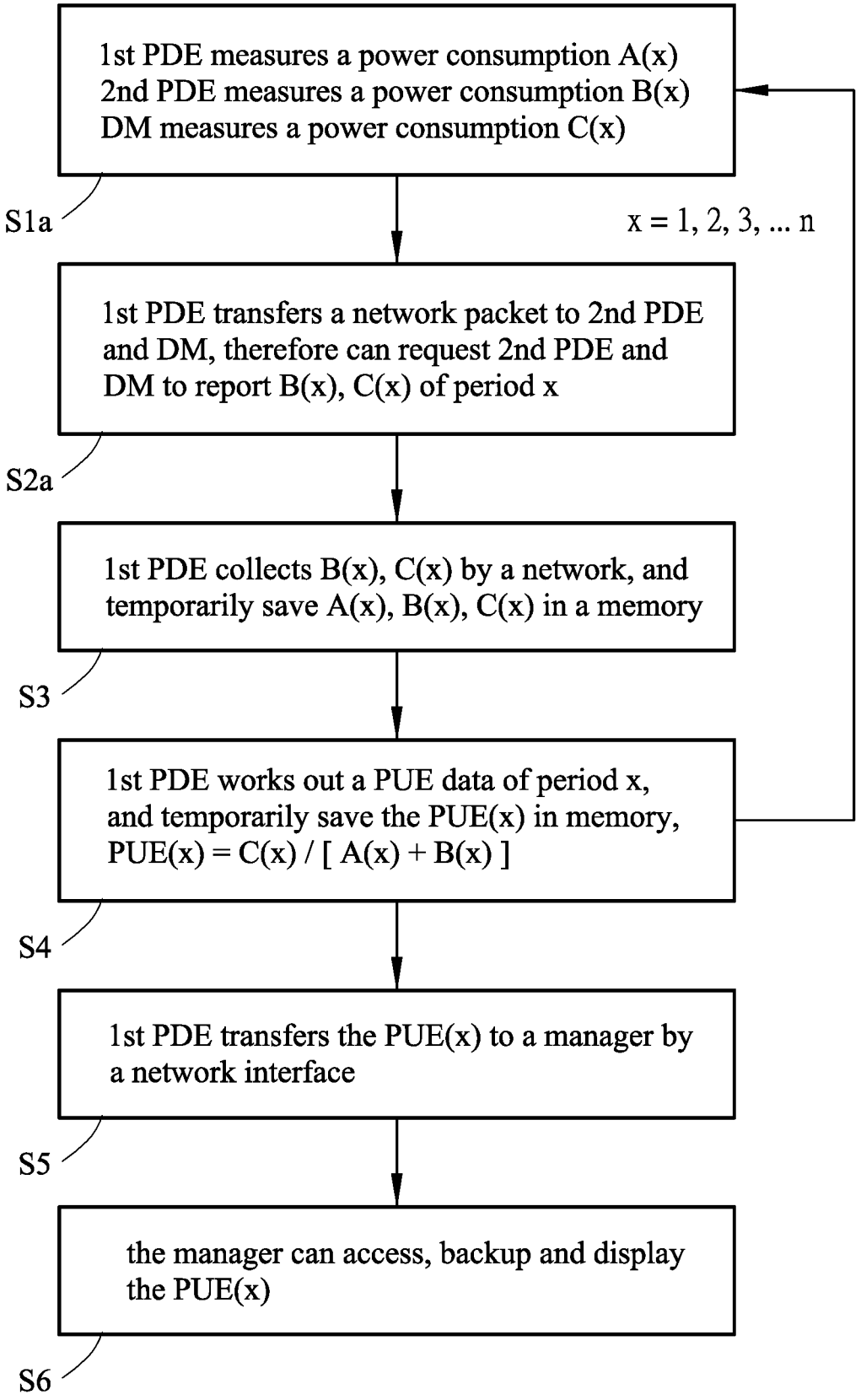
FIG. 6 is a flowchart illustrating the power management method of a sixth embodiment of the invention.

Referring to FIG. 6 and FIGS. 3 to 3A, a server room power management method in accordance with a sixth embodiment of the invention comprises a step S1*a*, a first PDE 1 measures a power consumption A(x) of a period x, at least one second PDE 2 measures a power consumption B(x) of the period x, and a DM 3 measures a power consumption C(x) of the period x; a step S2*a*, the first PDE 1 transfers a network packet to the second PDE 2 and the DM 3, therefore can request the second PDE 2 and the DM 3 to report the power consumptions B(x), C(x) of the period x ; a step S3, the first PDE 1 collects the power consumptions B(x), C(x) by a network, and the first PDE 1 will temporarily save the power consumptions A(x), B(x), C(x) in a first memory 16 of the first PDE 1; a step S4, the first PDE 1 works out a PUE (power usage effectiveness) data of the period x, the PUE data is determined by a formula as below: PUE(x)=C(x)/[A(x)+B(x)], the PUE(x) is the power usage effectiveness of the period x, and the first PDE 1 will temporarily save the PUE(x) in the first memory 16; looping steps S1*a* to S4, therefore can continuously measure the power consumptions A(x), B(x), C(x) of each period x, and continuously work out the PUE(x) of each period x, the value x is in a range from 1 to N; wherein the network is formed by a network hub 4 used a plurality of network cables 41-43 to connect to the first PDE 1, the second PDE 2 and the DM 3.

Examples of the PUE access steps, the PUE backup steps and the PUE display steps of the sixth embodiment will be illustrated below, the sixth embodiment further comprises a step S5, the first processor unit 11 of the first PDE 1 transfers the power usage effectiveness PUE(x) of each period x to a manager 5 by a first network interface unit 15; and a step S6, the manager 5 can access, backup and display the above PUE(x).

Figure 7:
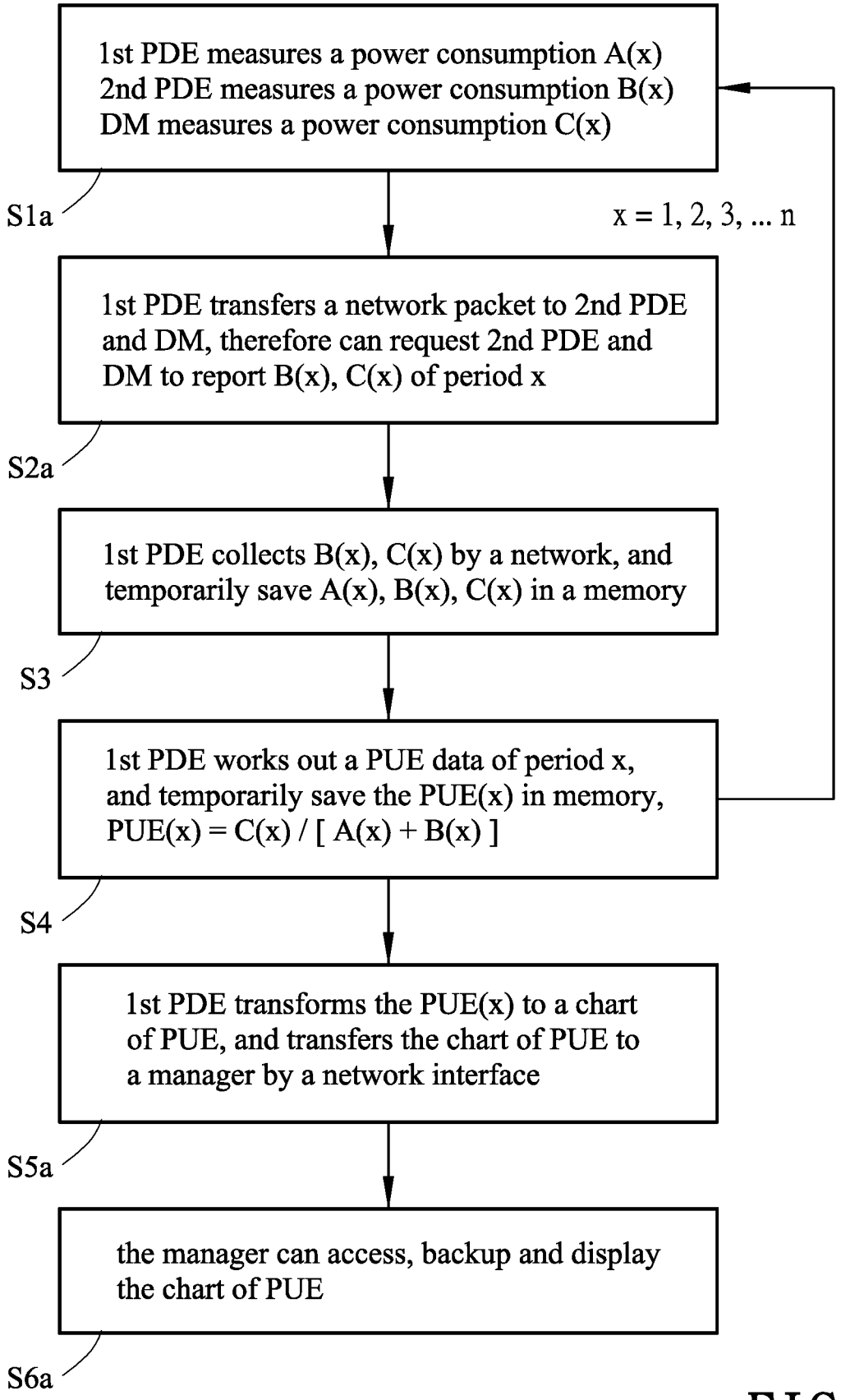
FIG. 7 is a flowchart illustrating the power management method of a seventh embodiment of the invention.

Referring to FIG. 7 and FIGS. 3 to 3A, a seventh embodiment method is almost same as the sixth embodiment method, the difference between them is, the seventh embodiment method has a step S5*a*, the first processor unit 11 of the first PDE 1 transforms the above PUE(x) to a chart of PUE, and the first processor unit 11 transfers the chart of PUE to a manager 5 by the first network interface unit 15; and a step S6*a*, the manager 5 can access, backup and display the chart of PUE.

Figure 8:
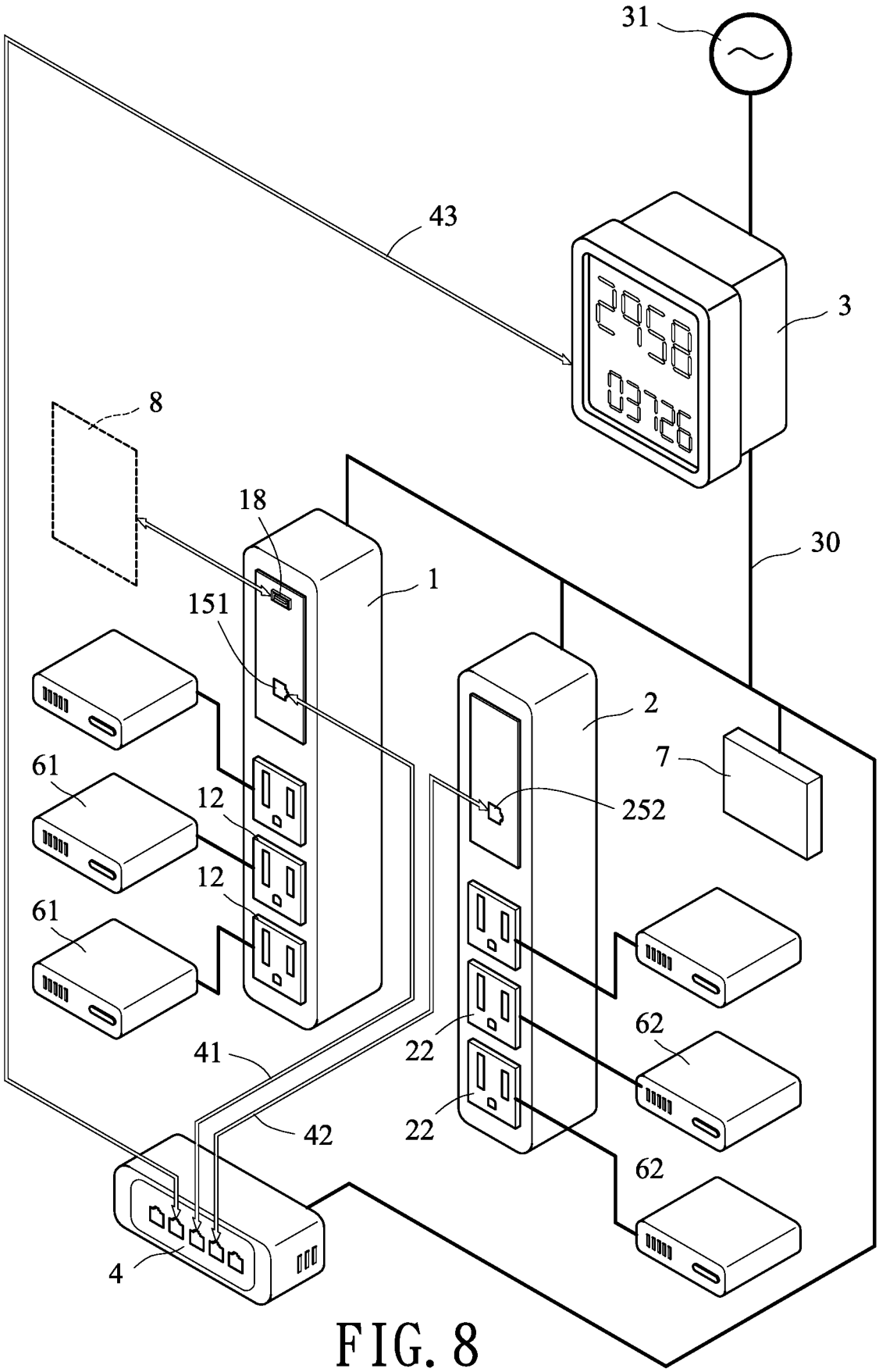
FIG. 8 is a perspective view showing a power management apparatus of a eighth embodiment of the invention.
Figure 8A:
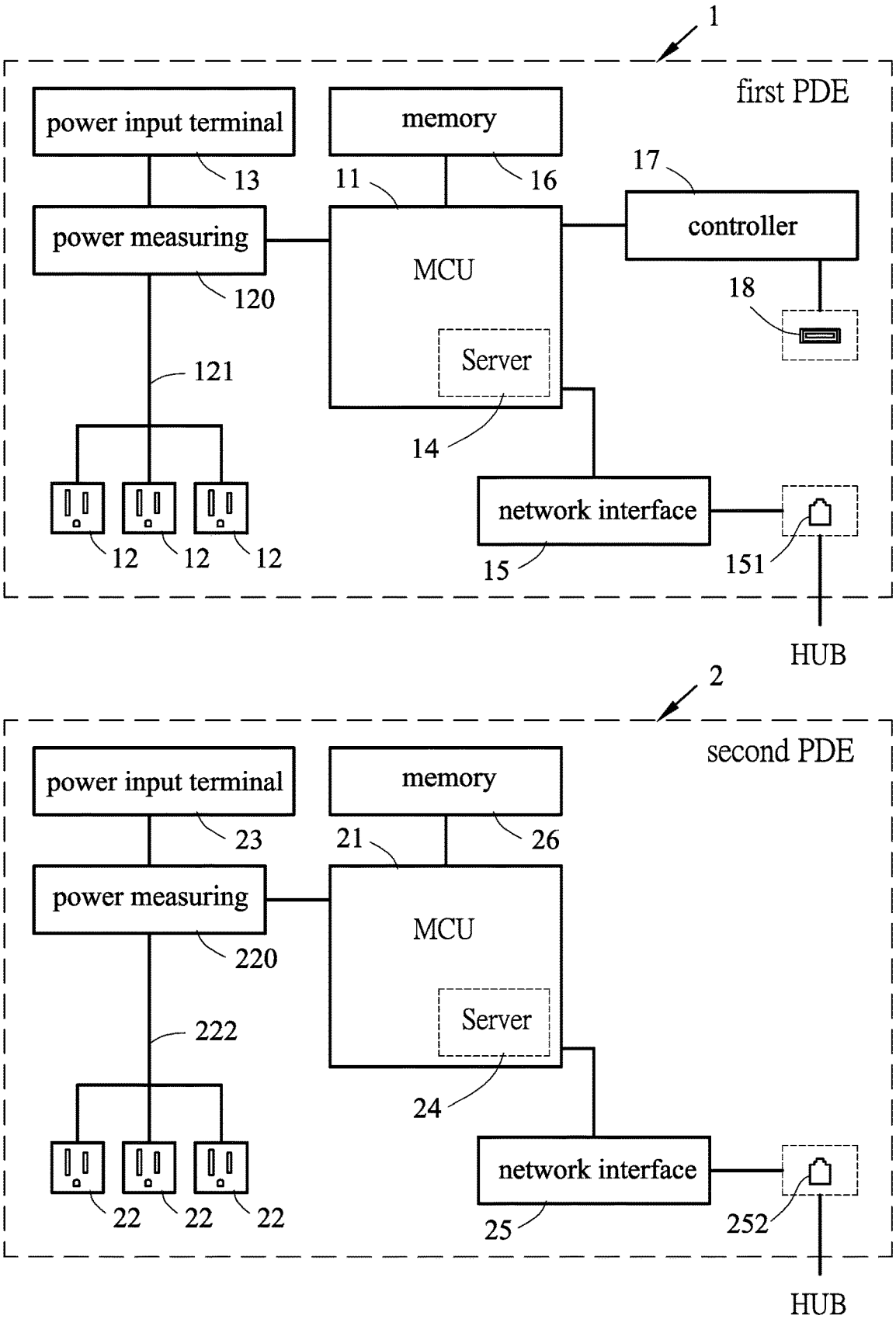
FIG. 8A is a functional block diagram illustrating the power management apparatus of the eighth embodiment of the invention.

Referring to FIGS. 8 to 8A, an eighth embodiment apparatus is almost same as the third embodiment apparatus, the difference between them is, the first PDE 1 further has a controller 17 and I/O port (input/output port) 18; wherein the controller 17 is connected to the first processor unit 11, the I/O port 18 is connected to the controller 17, the I/O port 18 can select from a USB socket or a Micro-USB socket.

Examples of the PUE access steps, the PUE backup steps and the PUE display steps of the eighth embodiment will be illustrated below, the I/O port 18 can connect a portable electronic device 8, the portable electronic device 8 can use the controller 17 to access, backup and display the PUE which is counted by the first processor unit 11; wherein the portable electronic device 8 can select from a smart cell phone, a tablet computer or a notebook computer. Moreover, the portable electronic device 8 can use the controller 17 to modify and renew the function setting of the first PDE 1. Furthermore, the I/O port 18 can be a memory card socket, a memory card can be inserted into the I/O port 18 (not shown), the memory card can use the controller 17 to save the PUE which is counted by the first processor unit 11, the memory card can select from a SD card, a Micro-SD card or a Micro-SDHC card.

Figure 9:
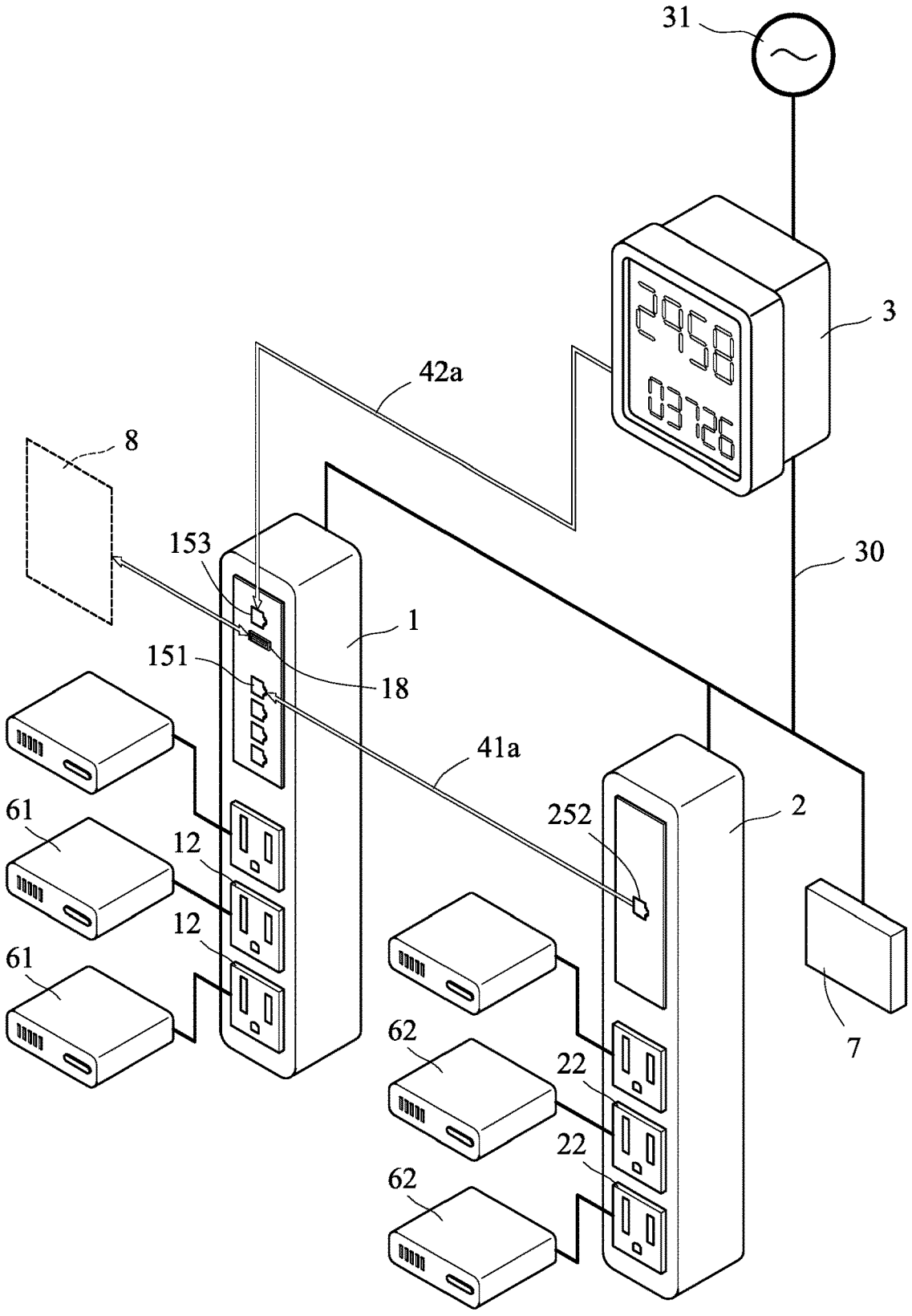
FIG. 9 is a perspective view showing a power management apparatus of a ninth embodiment of the invention.
Figure 9A:
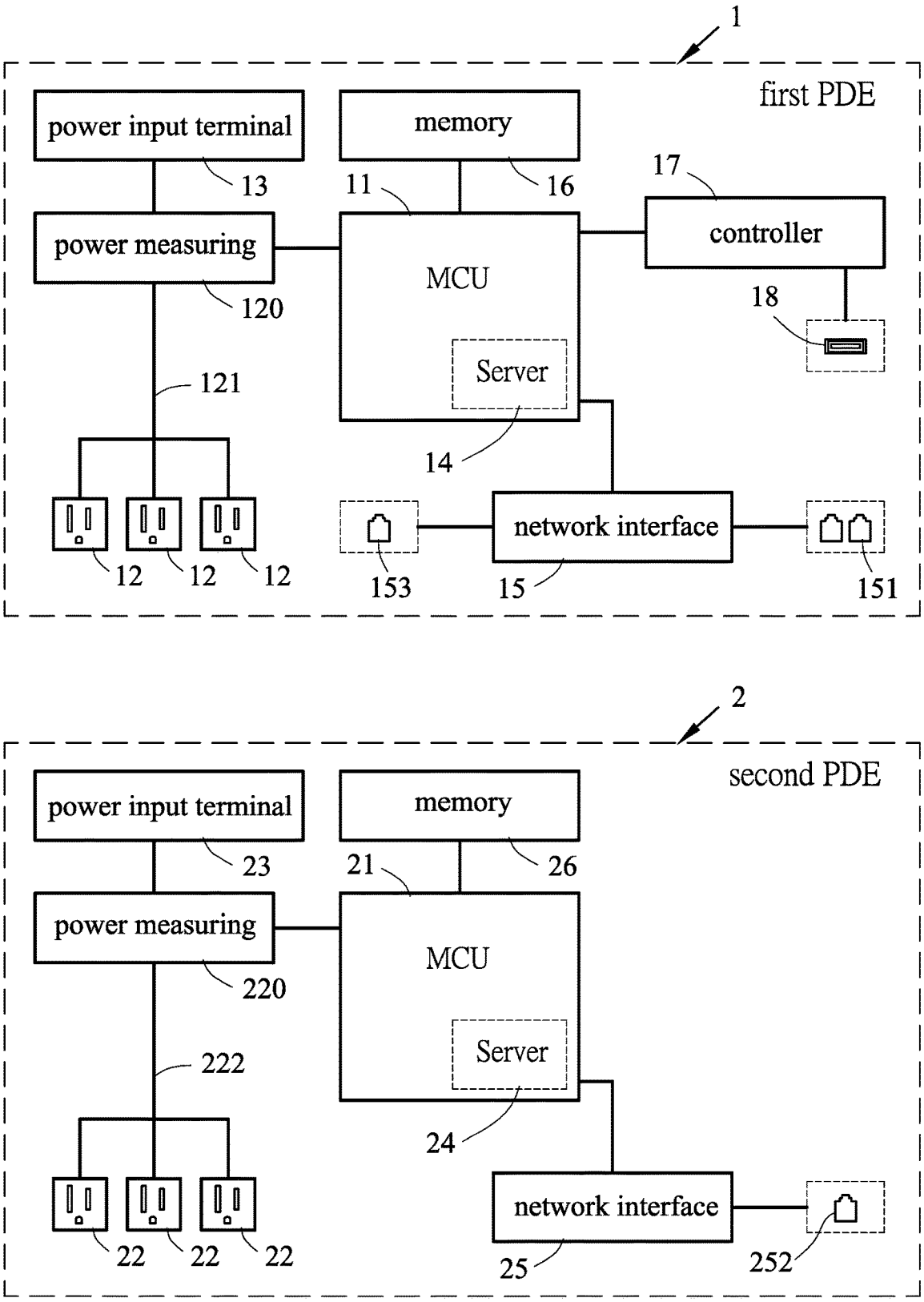
FIG. 9A is a functional block diagram illustrating the power management apparatus of the ninth embodiment of the invention.

Referring to FIGS. 9 to 9A, a ninth embodiment apparatus is almost same as the eighth embodiment apparatus, the difference between them is the network framework, a first network port 151 of the first network interface unit 15 uses a first network cable 41 a to connect to a second network port 252 of the second network interface unit 25, a third network port 153 of the first network interface unit 15 uses a second network cable 42*a* to connect to the DM 3, thereby the first PDE 1 and the second PDE 2 can transfer the signal each other, the first PDE 1 and the DM 3 can transfer the signal each other.

Figure 10:
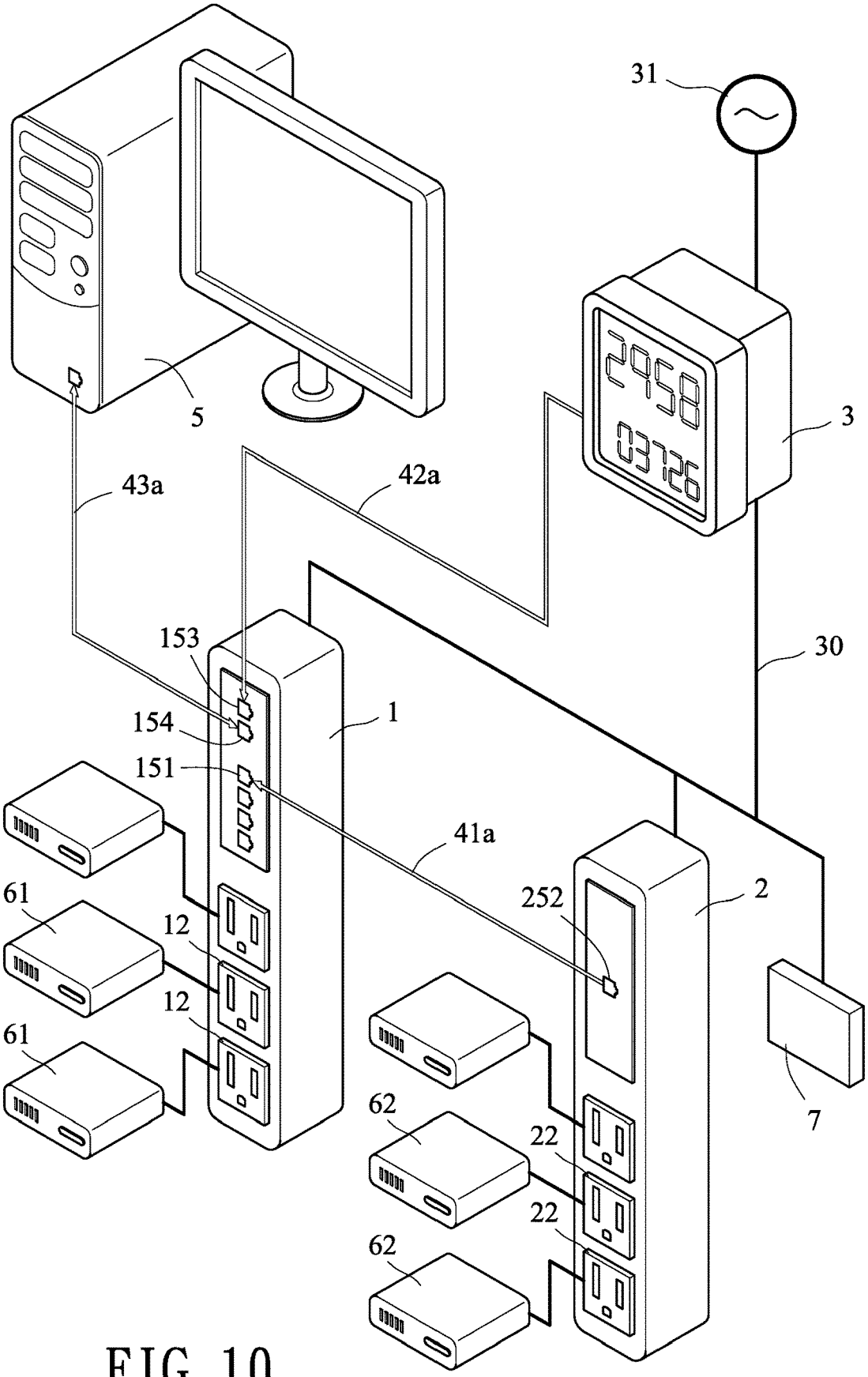
FIG. 10 is a perspective view showing a power management apparatus of a tenth embodiment of the invention.
Figure 10A:
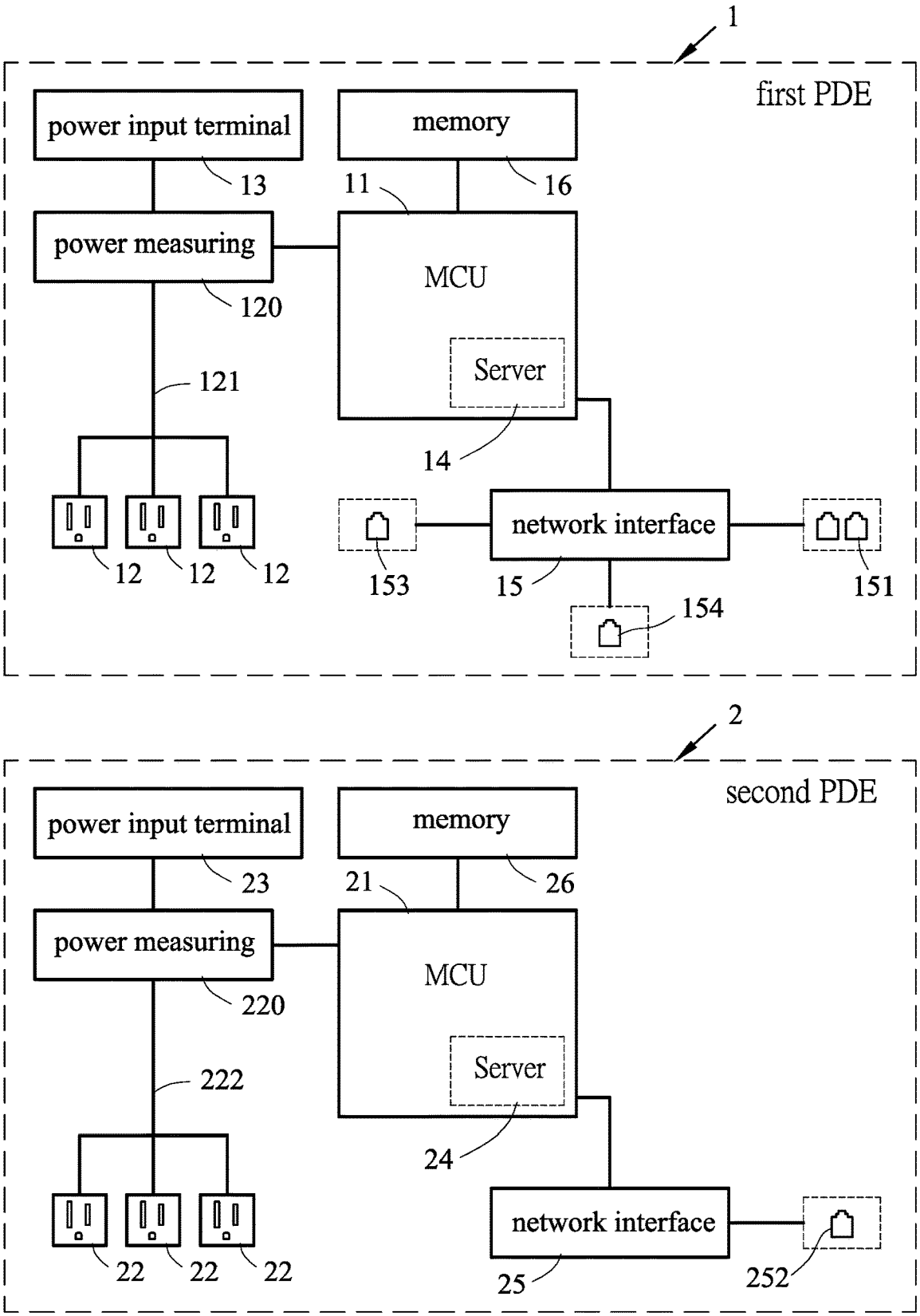
FIG. 10A is a functional block diagram illustrating the power management apparatus of the tenth embodiment of the invention.

Referring to FIGS. 10 to 10A, a tenth embodiment apparatus is almost same as the third embodiment apparatus, the difference between them is the network framework, a first network port 151 of the first network interface unit 15 uses a first network cable 41 a to connect to a second network port 252 of the second network interface unit 25, a third network port 153 of the first network interface unit 15 uses a second network cable 42*a* to connect to the DM 3; wherein a fourth network port 154 of the first network interface unit 15 can use a third network cable 43*a* to connect to a manager 5, therefore can access, backup and display the PUE which is counted by the first processor unit 11, the manager 5 can select from a personal computer, a notebook computer, a tablet computer or an all-in-one computer.

What is claimed is:

1. A server room power management apparatus comprising:

a first PDE (power distribution equipment) having a first processor unit and a plurality of first outlets, wherein the first processor unit uses a first current sensor, a first voltage sensor or a first power meter to measure a power consumption of the first outlets, and the first processor unit is connected to a first network interface unit;

at least one second PDE having a second processor unit and a plurality of second outlets, the second processor unit uses a second current sensor, a second voltage sensor or a second power meter to measure a power consumption of the second outlets, and the second processor unit is connected to a second network interface unit;

a standalone DM (digital meter), disposed outside the first PDE and the second PDE and connected between a mains power supply and a power line for measuring a power consumption of the power line, wherein a first power input terminal of the first PDE and a second power input terminal of the second PDE are connected to the power line;

a network hub, the network hub connected via a plurality of network cables to the first network interface unit, the second network interface unit and the standalone DM;

wherein the first processor unit collects an external power consumption information, the first processor unit works out a PUE (power usage effectiveness) according to the power consumption which is measured by the first current sensor, the first voltage sensor or the first power meter and the external power consumption information, and the external power consumption information includes the power consumption of the second PDE and the power consumption of the standalone DM.

2. The server room power management apparatus of claim 1, wherein the first and second processor units is an ARM-base MCU (microcontroller unit), and the first and second network interface units are selected from a built-in Ethernet interface or an optical fiber network interface.

3. The server room power management apparatus of claim 1, wherein the first and second outlets supply power to a plurality of information devices, and the power line supplies power to other devices.

4. The server room power management apparatus of claim 1, wherein the first PDE is provided with a PDE display, and therefore the PUE counted by the first processor unit can be shown on the first PDE.

5. The server room power management apparatus of claim 1, wherein the first processor unit is further connected to a display interface, the display interface is connected to a display output port, the display output port can connect to an independent display by a signal cable; the display interface is selected from a VGA (Video Graphics Array) interface, a HDMI (High Definition Multimedia) interface or a Mini Display interface; and the display output port is selected from a D-sub socket, a HDMI socket or a Mini Display socket.

6. The server room power management apparatus of claim 1, wherein the PUE counted by the first processor unit is temporarily saved in a first memory, and the network hub is connected to a manager and therefore is enabled to access, backup and display the PUE which is counted by the first processor unit; the manager being selected from a personal computer, a notebook computer, a tablet computer or an all-in-one computer.

7. A server room power management method comprising the steps of:

S1) transferring a network packet to at least one second PDE and a standalone DM by a first PDE, therefore can request the second PDE and the standalone DM to report self power consumption at regular time, wherein the standalone DM is disposed outside the first PDE and the second PDE, and is connected between a mains power supply and a power line for measuring a power consumption of the power line, wherein a first power input terminal of the first PDE and a second power input terminal of the second PDE are connected to the power line;

S2) measuring a power consumption A(x) of a period x by the first PDE, measuring a power consumption B(x) of the period x by the second PDE, and measuring a power consumption C(x) of the period x by the standalone DM;

S3) collecting the power consumptions B(x), C(x), the first PDE collecting the power consumptions B(x), C(x) by a network, and the first PDE will temporarily save the power consumptions A(x), B(x), C(x) in a memory of the first PDE;

S4) working out a PUE (power usage effectiveness) data of the period x by the first PDE, the PUE data being determined by a formula as below: PUE(x)=C(x)/[A(x)+B(x)], the PUE(x) is the power usage effectiveness of the period x, and the first PDE will temporarily save the PUE(x) in the memory of the first PDE;

looping steps S2) to S4), therefore can continuously measure the power consumptions A(x), B(x), C(x) of each period x, and continuously work out the PUE(x) of each period x, the value x is in a range from 1 to N;

wherein the network is formed by a network hub used a plurality of network cables to connect to the first PDE, the second PDE and the standalone DM.

8. The server room power management method of claim 7, wherein the method further comprises the steps of:

S5) transferring the PUE(x) of each period x to a manager, the first PDE can use a first network interface to transfer the PUE(x) of each period x; and S6) accessing the above PUE(x), the manager can access, backup and display the above PUE(x).

9. The server room power management method of claim 7, wherein the method further comprises the steps of:

S5*a*) transforming the above PUE(x) to a chart of PUE, the first PDE can transform the above PUE(x) to a chart of PUE, and the first PDE can use a first network interface to transfer the chart of PUE to a manager; and S6*a*) accessing the chart of PUE, the manager can access, backup and display the chart of PUE.

10. A server room power management method comprising the steps of:

S1*a*) measuring a power consumption A(x) of a period x by a first PDE, measuring at least one power consumption B(x) of the period x by at least one second PDE, and measuring a power consumption C(x) of the period x by a standalone DM, wherein the standalone DM is disposed outside the first PDE and the second PDE, and is connected between a mains power supply and a power line for measuring a power consumption of the power line, wherein a first power input terminal of the first PDE and a second power input terminal of the second PDE are connected to the power line;

S2*a*) transferring a network packet to the second PDE and the DM by the first PDE, therefore can request the second PDE and the standalone DM to report the power consumptions B(x), C(x) of the period x;

S3) collecting the power consumptions B(x), C(x), the first PDE can collect the power consumptions B(x), C(x) by a network, and the first PDE will temporarily save the power consumptions A(x), B(x), C(x) in a memory of the first PDE;

S4) working out a PUE (power usage effectiveness) data of the period x by the first PDE, the PUE data is determined by a formula as below: PUE(x)=C(x)/[A(x)+B(x)], the PUE(x) is the power usage effectiveness of the period x, and the first PDE will temporarily save the PUE(x) in the memory of the first PDE;

looping steps S1*a*) to S4), therefore can continuously measure the power consumptions A(x), B(x), C(x) of each period x, and continuously work out the PUE(x) of each period x, the value x is in a range from 1 to N;

wherein the network is formed by a network hub used a plurality of network cables to connect to the first PDE, the second PDE and the standalone DM.

11. A server room power management apparatus having at least one a first PDE, the first PDE comprising:

a first power input terminal, the first power input terminal is used to connect to a power line;

a plurality of first outlets, the first outlets are used to distribute a power source inputted from the first power input terminal;

a power meter, used to measure a power consumption of the first outlets;

a first processor unit, the first processor unit is used to work out a PUE, the first processor unit connects a first network interface unit;

a first memory unit, the first memory unit is used to save the PUE which is counted by the first processor unit, the first memory unit is connected to the first processor unit;

wherein the first processor unit collects an external power consumption information by the first network interface unit, the first processor unit works out the PUE which is determined by a formula as below: PUE(x)=C(x)/[A(x)+B(x)], the PUE(x) is the power usage effectiveness of the period x, the A(x) is a power consumption of the first PDE in the period x, the B(x) is a power consumption of at least one second PDE in the period x, and the C(x) is a power consumption of a standalone DM (digital meter), wherein the standalone DM is disposed outside the first PDE and the second PDE, and is connected between a mains power supply and a power line for measuring a power consumption of the power line, wherein a first power input terminal of the first PDE and a second power input terminal of the second PDE are connected to the power line.

12. The server room power management apparatus of claim 11, wherein the first processor unit is an ARM-base MCU.

13. The server room power management apparatus of claim 11, wherein the first network interface unit has a first network port, the first network interface unit is a built-in Ethernet interface or an optical fiber network interface, and the first network port is a RJ45 network socket or an optical fiber network socket.

14. The server room power management apparatus of claim 13, wherein the first network port is connected to a network hub by a network cable, and the network hub is connected to a plurality of at least one the second PDE and the standalone DM.

15. The server room power management apparatus of claim 13, wherein the first network port is connected to a second network interface unit of the second PDE by a first network cable, the first network cable is connected to a second network port of the second network interface unit; the first network interface unit has a third network port, and the third network port is connected to the standalone DM by a second network cable.

16. The server room power management apparatus of claim 13, wherein the first network interface unit has a fourth network port, the fourth network port is connected to a manager by a third network cable, and the manager is selected from a personal computer, a notebook computer, a tablet computer or an all-in-one computer.

17. The server room power management apparatus of claim 12, wherein the first PDE is provided with a PDE display, and therefore the PUE counted by the first processor unit can be shown on the first PDE.

18. The server room power management apparatus of claim 12, wherein the first processor unit is further connected to a display interface, the display interface is connected to a display output port, the display output port is connected to an independent display by a signal cable; the display interface is selected from a VGA interface, a HDMI interface or a Mini Display interface; and the display output port is selected from a D-sub socket, a HDMI socket or a Mini Display socket.

19. The server room power management apparatus of claim 12, wherein the first processor unit is further connected to a controller, the controller is connected to an I/O (input/output) port, the I/O port can be selected from a USB socket or a Micro-USB socket; and the I/O port is connected to a portable electronic device and therefore is enabled to access, backup and display the PUE which is counted by the first processor unit, and the portable electronic device uses the controller to modify and renew the function setting of the first PDE.

20. The server room power management apparatus of claim 12, wherein the first processor unit is further connected to a controller, the controller is connected to an I/O port, the I/O port is a memory card socket, a memory card can be inserted into the I/O port and therefore save the PUE which is counted by the first processor unit, and the memory card is selected from a SD card, a Micro-SD card or a Micro-SDHC card.

21. A server room power management apparatus having at least one a first PDE, the first PDE comprising:

a first power input terminal, the first power input terminal is used to connect to a power line;

a plurality of first outlets, the first outlets are used to distribute a power source inputted from the first power input terminal;

a current sensor, used to measure a power consumption of the first outlets;

a first processor unit, the first processor unit is used to work out a PUE, the first processor unit connects a first network interface unit;

a first memory unit, the first memory unit is used to save the PUE which is counted by the first processor unit, the first memory unit is connected to the first processor unit;

wherein the first processor unit collects an external power consumption information by the first network interface unit, the first processor unit works out the PUE which is determined by a formula as below: PUE(x)=C(x)/[A(x)+B(x)], the PUE(x) is the power usage effectiveness of the period x, the A(x) is a power consumption of the first PDE in the period x, the B(x) is a power consumption of at least one second PDE in the period x, and the C(x) is a power consumption of a standalone DM (digital meter), wherein the standalone DM is disposed outside the first PDE and the second PDE, and is connected between a mains power supply and the power line for measuring a power consumptions of the power line, wherein the first power input terminal of the first PDE and a second power input terminal of the second PDE are connected to the power line.

22. A server room power management apparatus having at least one a first PDE, the first PDE comprising:

a first power input terminal, the first power input terminal is used to connect to a power line;

a plurality of first outlets, the first outlets are used to distribute a power source inputted from the first power input terminal;

a voltage sensor, used to measure a power consumption of the first outlets; a first processor unit, the first processor unit is used to work out a PUE, the first processor unit connects a first network interface unit;

a first memory unit, the first memory unit is used to save the PUE which is counted by the first processor unit, the first memory unit is connected to the first processor unit;

wherein the first processor unit collects an external power consumption information by the first network interface unit, the first processor unit works out the PUE which is determined by a formula as below: PUE(x)=C(x)/[A(x)+B(x)], the PUE(x) is the power usage effectiveness of the period x, the A(x) is a power consumption of the first PDE in the period x, the B(x) is a power consumption of at least one second PDE in the period x, and the C(x) is a power consumption of a standalone DM (digital meter), wherein the standalone DM is disposed outside the first PDE and the second PDE, and is connected between a mains power supply and the power line for measuring a power consumptions of the power line, wherein the first power input terminal of the first PDE and a second power input terminal of the second PDE are connected to the power line.

* * * * *